United States Patent [19]

Smith

[11] Patent Number: 4,823,725

[45] Date of Patent: Apr. 25, 1989

[54] OUTBOARD MOTORBOAT WITH SPACE SAVER POCKET TRANSOM

[75] Inventor: Delbert G. Smith, Little Falls, Minn.

[73] Assignee: Nordic Boat Company, Inc., Little Falls, Minn.

[21] Appl. No.: 157,290

[22] Filed: Feb. 17, 1988

[51] Int. Cl.[4] ..... B63B 5/00

[52] U.S. Cl. ..... 114/343; 248/641

[58] Field of Search ..... 114/343, 355; 248/640, 248/641

[56] References Cited

U.S. PATENT DOCUMENTS

| | | | |
|---|---|---|---|
| 2,764,119 | 9/1956 | Sigler | 248/641 |
| 2,816,298 | 12/1957 | Foster | 114/357 |
| 2,842,086 | 7/1958 | Yost | 248/641 |
| 4,669,698 | 6/1987 | McGuire | 248/641 |
| 4,708,087 | 11/1987 | Potter | 248/640 |

*Primary Examiner*—Sherman D. Basinger
*Assistant Examiner*—Thomas J. Brahan
*Attorney, Agent, or Firm*—Barnes, Kisselle, Raisch, Choate, Whittemore & Hulbert

[57] ABSTRACT

An outboard motorboat having a buttress panel located aft of the transom to receive and mount an outboard motor thereon. The transom has a space saver pocket or motorwell therein which provides a clearance between the transom and the motor even when the motor pivots from a fully lowered position to a fully raised position, and from a fully rotated generally clockwise position to a fully rotated generally counterclockwise position, and vice versa.

12 Claims, 2 Drawing Sheets

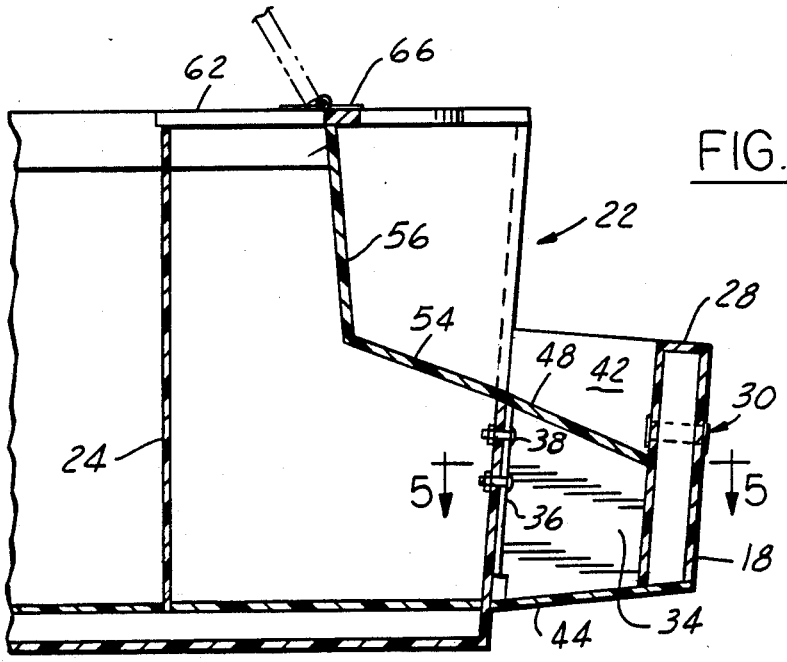
FIG.4
FIG.5
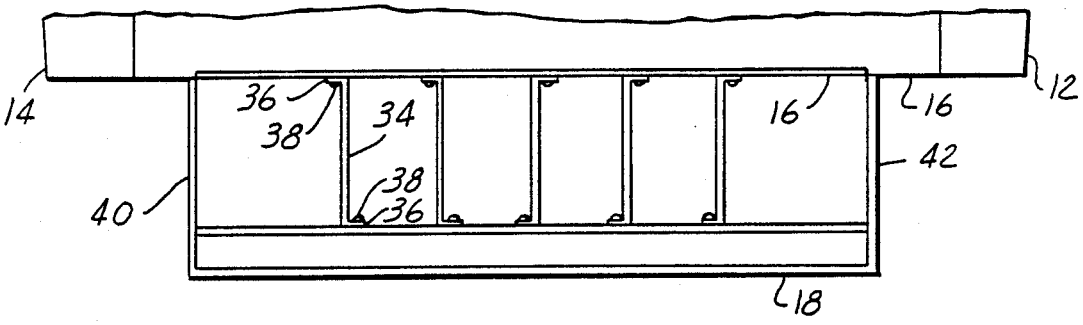
FIG.6
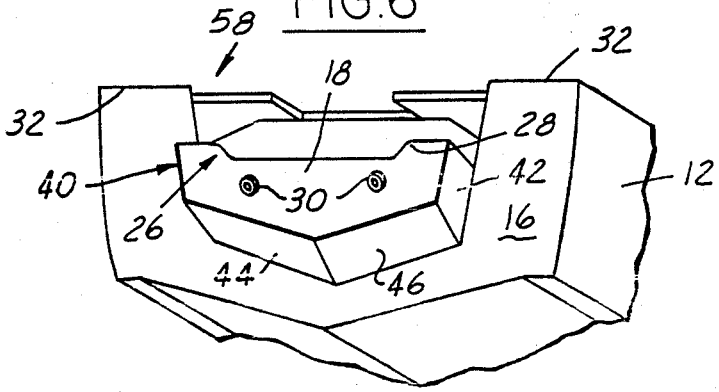

OUTBOARD MOTORBOAT WITH SPACE SAVER POCKET TRANSOM

FIELD OF THE INVENTION

This invention relates to boats, and more particularly to the mounting of an outboard motor on a boat.

BACKGROUND

Outboard motorboats of the prior art have transoms which require large open motorwells to accommodate an outboard motor in its full tilt position and consequently consume a lot of room in the cockpit of the boat. Such outboard motorboats have a high noise level, inadequate storage space in the transom, inadequately prevent splash from entering the cockpit, and are generally unsightly.

SUMMARY OF THE INVENTION

An outboard motorboat having a buttress panel located aft of the transom and constructed and arranged to receive and mount an outboard motor thereon. The transom has a space saver pocket or motorwell formed therein which provides a clearance between the transom and the motor, as it is rotated fully clockwise and counterclockwise and as it is pivoted fully upwardly and downwardly.

Objects, features and advantages of this invention are to provide an outboard motorboat having a buttress panel located aft of the transom for mounting an outboard motor thereon, a space saver pocket or motorwell formed in the transom, additional useable cockpit space in the boat, reduced noise level experienced by passengers of the boat, substantially less splash entering the cockpit, additional storage space in the transom area, and a mounting of an outboard motor which is pleasing to the eye.

BRIEF DESCRIPTION OF THE DRAWINGS

These and other objects, features and advantages of this invention will be apparent from the detailed description, appended claims and accompanying drawings in which:

FIG. 4 is a sectional view taken generally along line 4—4 in FIG. 2;

FIG. 5 is a sectional plan view taken generally along line 5—5 in FIG. 4; and

FIG. 6 is a fragmentary perspective view of the stern and bottom of the boat of FIG. 1.

DETAILED DESCRIPTION

Figure 1:
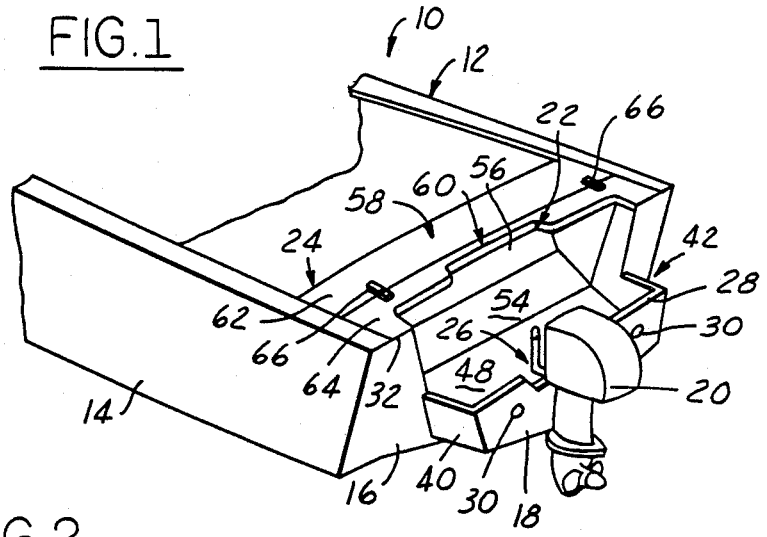
FIG. 1 is a fragmentary perspective view of a boat embodying this invention.
Figure 2:
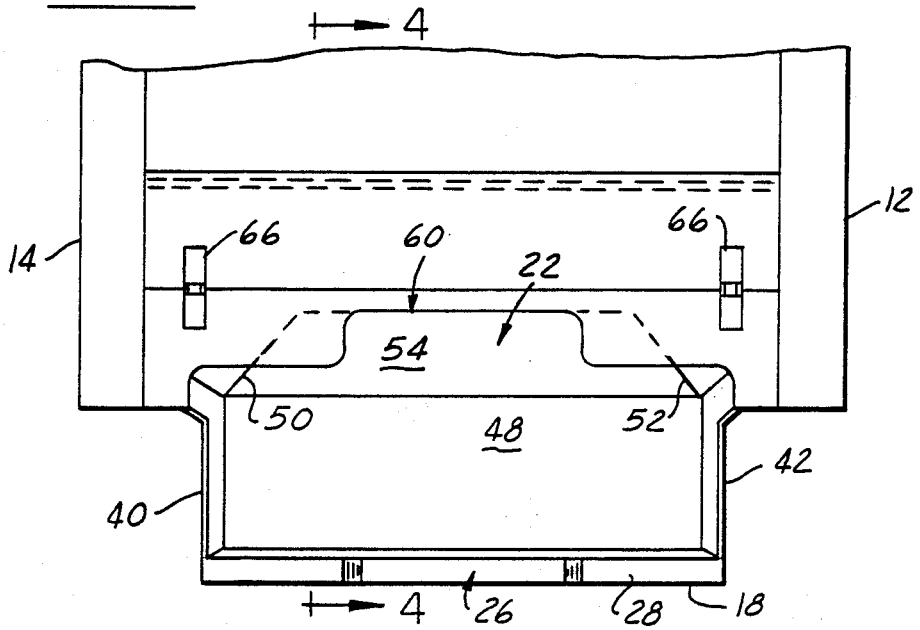
FIG. 2 is a fragmentary plan view of the boat of FIG. 1.
Figure 3:
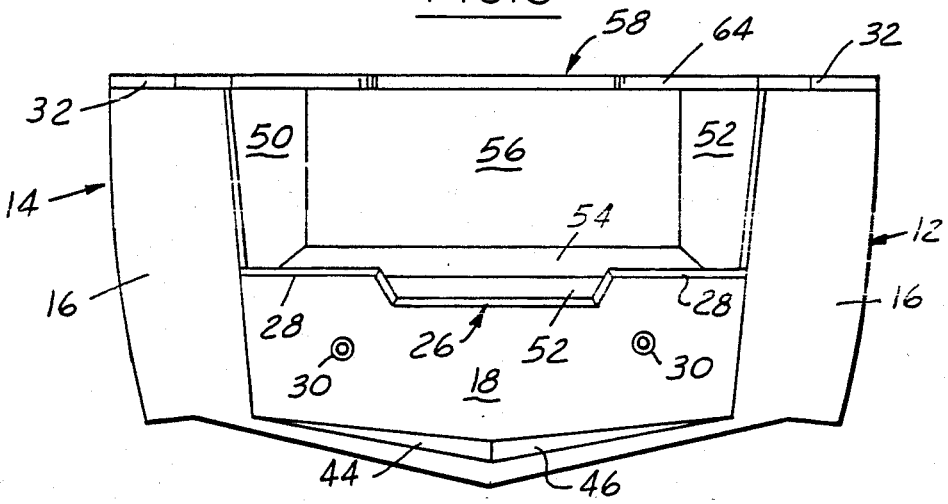
FIG. 3 is an end view of the boat of FIG. 1.

FIG. 1 illustrates an outboard motorboat 10 with opposed side walls 12, 14 and a transom 16 extending therebetween. A buttress panel 18 receives and mounts an outboard motor 20 aft of the transom 16. A space saver pocket or motorwell 22 is formed in the transom and provides a clearance between the transom and the motor as the motor is rotated fully clockwise and counterclockwise and as it is pivoted fully upwardly and downwardly. Preferably, an upright bulk head 24 is positioned afore the transom 16 and extends transversely between the inner edges of the side walls 12, 14 of the boat 10. The bulk head 24 may be pivoted upwardly to provide access to the space between the transom and the bulk head thereby providing additional storage space.

The buttress panel 18 is mounted aft the transom 16, and generally parallel thereto, a distance usually ranging from about 10 to 24 inches and preferably about 14 inches. The buttress panel 18 is preferably constructed from a plurality of laminated panels having a total thickness ranging from about $1\frac{1}{2}$ to $2\frac{1}{2}$ inches, and preferably about 2 inches. Desirably, the buttress panel has a width and height of about one-fourth to about three-fourths, and preferably one-half that of the transom. Preferably, the buttress panel has a notch 26 in its upper edge 28 for receiving and mounting an outboard motor thereon. The buttress panel has a pair of scuppers 30 formed therein to allow discharge of water. Preferably, the upper edge 28 of the buttress panel lies below the upper edge 32 of the transom. Preferably, the buttress panel is mounted on the transom by a plurality of generally perpendicular support panels 34 with flanges 36 secured by bolts 38.

To reduce drag on the boat and for improved appearance, the support panels 34 are enclosed and concealed from view by a pair of side panels 40, 42, a pair of bottom panels 44, 46 and a top panel 48 which extends between the buttress panel and the transom. Preferably, the top and bottom panels are reinforced by bearing on ends of the support panel 34.

The space saver pocket or motorwell 22 is formed in the transom by a pair of side panels 50, 52, a bottom panel 54, and a front panel 56. Preferably, the pair of side panels 50, 52 are inclined slightly inward toward the centerline of the boat and the bottom panel 54 is tilted slightly upward. It is believed that this construction acts to guide motor noise waves toward the front panel 56 from which they bounce off and thus reduce the noise experienced by passengers in the boat cockpit.

Noise is further reduced by a cover 58 which overlies the other motorwell panels 50, 52, 54, 46 and extends between the inner edges of the opposed side walls of the boat. Preferably, the cover 58 is removably mounted and has a notch 60 formed therein to provide a clearance between the cover and the motor as it pivots. The cover also prevents water from splashing into the cockpit.

Preferably the cover 58 is bifurcated longitudinally into a first 62 and second 64 sections. The sections are connected by a pair of hinges 66 so that the second cover section 64 pivots generally upwardly to provide access to the motorwell and outboard motor. If desired, the first section 62 can also be hinged so it can be opened to provide easy access to the storage area between the transom 16 and the bulkhead 24.

I claim:

1. An outboard motorboat of the type having sides and a transom and which further comprises:

a buttress panel constructed and arranged to receive and mount an outboard motor thereon, means securing said buttress panel to said boat aft of said transom and in a generally upright position, said buttress panel having a width and a height each of at least about one-fourth of that of said transom and wherein the upper edge of said buttress panel lies below the upper edge of said transom, a motorwell in said transom and having a bottom, sides and front constructed and arranged to provide clearance between such motor and said transom as such motor when mounted on said buttress panel pivots from its fully lowered position to its fully raised position and when in such fully raised position from a fully rotated generally clockwise position to a fully rotated generally counterclockwise position, and a cover disposed between the sides of the boat and superimposed over said front and at least a portion of said sides, and bottom of said motorwell, and said cover having a notch formed therein constructed and arranged to provide a clearance between said cover and said motor as said motor pivots from its fully lowered position to its fully raised position and when in such fully raised position from its fully rotated generally clockwise position to its fully rotated generally counterclockwise position.

2. The outboard motorboat of claim 1 wherein said means for securing said buttress panel aft of said transom comprises a plurality of support panels extending between and generally perpendicular to said buttress panel and said transom.

3. The outboard motorboat of claim 2 further comprising side panels, bottom panels and top panels extending between said buttress panel and said transom and constructed and arranged to conceal said support panels from view.

4. The outboard motorboat of claim 3 wherein said sides of said motorwell are inclined inward toward the centerline of the boat, and said bottom of said motorwell is tilted generally upwardly toward the front of the boat.

5. The outboard motorboat of claim 1 wherein said cover is bifurcated longitudinally into at least a first section and a second section, said sections being connected by hinges and constructed and arranged such that said second section pivots generally upwardly thereby providing access to said motorwell and outboard motor.

6. The outboard motorboat of claim 1 further comprising scuppers in said buttress panel.

7. The outboard motorboat of claim 1 wherein said buttress panel is located aft of said transom a distance in the range of about 10 inches to 25 inches.

8. The outboard motorboat of claim 1 wherein the height and width of said buttress panel is in the range of about one-fourth to three-fourths of the height and width respectively of said transom.

9. The outboard motorboat of claim 1 wherein said buttress panel has a notch in its upper edge for mounting an outboard motor thereon.

10. The outboard motorboat of claim 1 which also comprises a bulkhead forward of said front of said motorwell and said cover overlies and provides access to an opening between such bulkhead and front of said motorwell.

11. The outboard motorboat of claim 10 wherein said cover is bifurcated longitudinally into at least a first section and a second section, said sections being connected by hinges and constructed and arranged such that said second section pivots generally upwardly thereby providing access to said motorwell and outboard motor.

12. The outboard motorboat of claim 11 wherein said first section of said cover is also hinged to be opened to provide access to an underlying area between such bulkhead and front of said motorwell.

* * * * *